US005910387A

United States Patent [19]

Mychajlowskij et al.

[11] Patent Number: 5,910,387

[45] Date of Patent: Jun. 8, 1999

[54] TONER COMPOSITIONS WITH ACRYLONITRILE AND PROCESSES

[75] Inventors: Walter Mychajlowskij; Beng S. Ong; Emily L. Moore, all of Mississauga; Raj D. Patel, Oakville, all of Canada

[73] Assignee: Xerox Corporation, Stamford, Conn.

[21] Appl. No.: 09/006,521

[22] Filed: Jan. 13, 1998

[51] Int. Cl.[6] ..... G03G 9/087

[52] U.S. Cl. ..... 430/110; 430/137

[58] Field of Search ..... 430/107, 110, 430/137

[56] References Cited

U.S. PATENT DOCUMENTS

| | | | |
|---|---|---|---|
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |
| 5,683,848 | 11/1997 | Ong et al. | 430/137 |

*Primary Examiner*—John Goodrow
*Attorney, Agent, or Firm*—E. O. Palazzo

[57] ABSTRACT

A toner composition comprised of colorant, and an addition polymer resin of styrene, butadiene, acrylonitrile and acrylic acid.

22 Claims, No Drawings

TONER COMPOSITIONS WITH ACRYLONITRILE AND PROCESSES

PATENTS AND PENDING APPLICATIONS

Illustrated in U.S. Pat. No. 5,683,848, the disclosure of which is totally incorporated herein by reference, is a toner and processes thereof, and wherein the toner is generated from, for example, about 55 to 80 weight percent of styrene, about 1 to 25 weight percent of acrylate, about 1 to 20 weight percent of acrylonitrile, and about 0.5 to 5 weight percent of acrylic acid. The present invention, which selects a toner resin containing a butadiene, enables toners with excellent toner fusing properties, and acceptable blocking temperatures, for example blocking temperatures of greater than about 47° C. without adversely effecting the toner fusing temperature, an advantage over the above toner. The incorporation of a butadiene in the resin also provides for improved toner resin mechanical properties, and thus excellent toner fusing characteristics primarily since, for example, polybutadiene resin has a lower critical molecular weight of entanglement ($M_c$ is about 5,000) than polyacrylate resin with an $M_c$ for polymethyl acrylate being about 25,000.

The following copending applications, the disclosures of which are totally incorporated herein by reference, are being filed concurrently herewith.

U.S. Pat. No. 5,840,462 discloses a toner process wherein a colorant is flushed into a sulfonated polyester, followed by the addition of an organic soluble dye and an alkali halide solution.

U.S. Pat. No. 5,853,944 discloses a toner process with a first aggregation of sulfonated polyester, and thereafter, a second aggregation with a colorant dispersion and an alkali halide.

U.S. Ser. No. 09/006,640 discloses a toner process wherein a latex emulsion and a colorant dispersion are mixed in the presence of an organic complexing agent or compound, and wherein the latex can contain a sodio sulfonated polyester resin.

U.S. Ser. No. 09/006,553 discloses a toner process wherein there is mixed an emulsion latex, a colorant dispersion, and a monocationic salt, and wherein the resulting mixture possesses an ionic strength of about 0.001 molar to about 5 molar.

U.S. Ser. No. 09/006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Ser. No. 09/006,508 discloses a toner process by blending an aqueous colorant dispersion with a latex blend containing a linear polymer and soft crosslinked polymer particles.

U.S. Ser. No. 09/006,742 discloses a toner process wherein there is mixed an aqueous colorant dispersion and an emulsion latex, followed by filtering, and redispersing the toner formed in water at a pH of above about 7 and contacting the resulting mixture with a metal halide or salt and then with a mixture of an alkaline base and a salicylic acid, a catechol, or mixtures thereof.

BACKGROUND OF THE INVENTION

The present invention is generally directed to toner compositions and processes, and more specifically, to toner compositions derived from styrene-butadiene-acrylonitrile-acrylic acid resins, and obtained by a chemical process involving aggregation and coalescence of resin and colorant, such as pigment particles. With the toner compositions of the present invention, which are derived from styrene-butadiene-acrylonitrile-acrylic acid resins, improvements in toner performance, such as superior image fix on various types of substrates, such as paper, is achievable.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained.

Emulsion/aggregation processes for the preparation of toners are illustrated in a number of Xerox Corporation patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of these Xerox patents may be selected for the present invention.

SUMMARY OF THE INVENTION

Examples of features of the present invention in embodiments thereof include:

It is a feature of the present invention to provide toner compositions and processes with many of the advantages illustrated herein.

In another feature of the present invention there are provided simple and economical chemical processes for the preparation of black and colored toner compositions with a particle size of from, for example, about 1 to about 20 microns, and more specifically, from about 2 to about 10 microns in volume average diameter, and a narrow GSD of less than 1.35, and more specifically, from about 1.15 to about 1.25 without the need for conventional classifications.

In another feature of the present invention there are provided simple and economical processes for black and colored toner compositions which provide excellent image fix and gloss characteristics on different paper substrates.

A further feature of the present invention is the provision of toner compositions with resins derived from the emulsion polymerization of a mixture of styrene, butadiene, acrylonitrile and acrylic acid, and which compositions enable excellent image fix and gloss characteristics ideal for process color applications, and high blocking temperatures.

In an associated feature of the present invention there are provided toner compositions which are obtained by aggregation and coalescence of latex, pigment and optional additive particles, and wherein the latex is obtained from emulsion polymerization of a mixture of acrylonitrile, butadiene, styrene, and acrylic acid.

In a further feature of the present invention there is provided a chemical toner preparative process involving aggregation and coalescence of latex, colorant, such as pigment, and optional additive particles, and wherein specific toner particle size of from 1 to about 20 microns, and more specifically, from about 2 to about 10 microns in volume average diameter, are precisely achieved by, for example, proper control of the temperature at which aggregation is accomplished, and which temperature is generally in the range of from about 30° C. to about 65° C.

In a further feature of the present invention there is provided a process for the preparation of toner compositions with excellent colorant, especially pigment dispersion, thus enabling the generation of high quality reprographic color images with excellent color fidelity and image projection efficiency.

In yet another feature of the present invention there are provided toner compositions with lower fusing temperature characteristics of, for example, about 5° C. to about40° C. lower than those of conventional styrene-based toners.

In another feature of the present invention there is provided a preparative process by which toner compositions comprising a pigment, optional additives, and a polymer resin generated from acrylonitrile, butadiene, styrene, and acrylic acid monomers are obtained in high process yield of over 90 percent.

Moreover, in another feature of the present invention there are provided toner compositions with high image projection efficiency, such as from about 65 to over 90 percent, and more specifically, about 95 percent, as measured by the Match Scan II spectrophotometer available from Milton-Roy.

Another feature of the present invention resides in preparative processes for small sized toners having a particle size of from about 2 to about 10 microns in volume average diameter, and a GSD of less than about 1.25.

The present invention relates to a toner composition comprised of colorant, and an addition polymer resin of styrene, butadiene, acrylonitrile and acrylic acid; a toner composition wherein the resin is derived from about 55 to about 85 weight percent of styrene, from about 1 to about 25 weight percent of butadiene, from about 1 to about 20 weight percent of acrylonitrile, and from about 0.5 to about 5 weight percent of acrylic acid; a toner wherein the resin possesses a weight average molecular weight ($M_w$) of from about 15,000 to about 35,000 and a number average molecular weight ($M_n$) of from about 3,000 to about 12,000, relative to styrene standards; a toner composition containing a styrene-butadiene-acrylonitrile-acrylic acid resin derived from emulsion polymerization of from about 65 to about 80 weight percent of styrene, from about 15 to about 25 weight percent of butadiene, from about 1 to about 10 weight percent of acrylonitrile, and from about 0.5 to about 3 weight percent of acrylic acid, and wherein said resin has a weight average molecular weight ($M_w$) of from about 18,000 to about 30,000 and a number average molecular weight ($M_n$) of from about 5,000 to about 10,000, relative to styrene standards; a toner wherein the resin possesses an $M_w$ of from about 20,000 to about 30,000, and an $M_n$ of from about 5,000 to about 10,000, relative to styrene standards; a toner wherein the resin possesses an $M_w$ of from about 20,000 to about 25,000, and an $M_n$ of about 6,000 to 8,000, relative to the styrene standards; a toner wherein the toner provides excellent image fix at a fusing temperature of from about 125° C. to about 170° C., and wherein the toner image gloss is 50, and $G_{50}$ temperature thereof is from about 130° C. to about 165° C.; a toner wherein the colorant is selected from the group consisting of black, cyan, magenta, yellow, blue, green, brown, and mixtures thereof; a toner further containing a charge control additive; a toner wherein the charge control additive is selected from the group consisting of distearyl dimethyl ammonium methyl sulfate, cetyl pyridinium halide, distearyl dimethyl ammonium bisulfate, metal complexes of salicylates, and mixtures thereof; a toner further containing wax, and surface additives; a developer comprised of toner and carrier; a developer wherein the toner is comprised of colorant, and a styrene-butadiene-acrylonitrile-acrylic acid resin obtained from emulsion polymerization of from about 55 to about 82 weight percent of styrene, from about 5 to about 25 weight percent of butadiene, from about 1 to about 20 weight percent of acrylonitrile, and from about 0.5 to about 5 weight percent of acrylic acid; and a toner wherein the resin has a weight average molecular weight ($M_w$) of from about 15,000 to about 35,000 and a number average molecular weight ($M_n$) of from about 3,000 to about 12,000, relative to styrene standards; a developer wherein the carrier is comprised of a metal core with a polymer coating; a process for the preparation of toner comprising (i) preparing in the presence of an ionic surfactant and an optional nonionic surfactant a latex emulsion generated from the emulsion polymerization of a mixture of from about 55 to about 85 weight percent of styrene, from about 1 to about 25 weight percent of butadiene, from about 1 to about 20 weight percent of acrylonitrile, and from about 0.5 to about 5 weight percent acrylic acid;

(ii) mixing said latex emulsion with an aqueous colorant dispersion containing an ionic surfactant that is of opposite charge polarity to the ionic surfactant present in said latex emulsion;

(iii) heating the resultant mixture at a temperature of about 30° C. to about 1° C. about below, or about equal to the Tg of the latex resin to form aggregates;

(iv) subsequently heating said aggregates at a temperature of from about 1° C. to about 60° C. about above, or about equal to the Tg of the latex resin; and optionally (v) cooling, and isolating said toner, followed by washing, and drying; a process wherein the aggregate size, and thus the final toner particle size is from about 1 to about 15 microns in volume average diameter, and wherein (v) is accomplished; a process wherein the final toner particle size distribution GSD is less than about 1.35, and wherein (v) is accomplished; a process wherein acrylonitrile in said emulsion polymerization is present in amounts of about 2 to 10 weight percent, and wherein (v) is accomplished; a process wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly (ethyleneoxy)ethanol; and wherein the anionic surfactant is selected from the group consisting of sodium dodecyl sulfate, sodium dodecylbenzene sulfate and sodium dodecylnaphthalene sulfate, and wherein (v) is accomplished; a process wherein the nonionic surfactant concentration is from about 0 to about 5 weight percent, the anionic surfactant concentration is about 0.01 to about 10 weight percent, and the cationic surfactant concentration is about 0.01 to about 10 weight percent of the reaction mixture; and wherein (v) is accomplished; a process for the preparation of toner comprising (i) mixing a latex containing styrene, butadiene, acrylonitrile, acrylic acid and an ionic surfactant, and an aqueous colorant dispersion containing an ionic surfactant that is of opposite charge polarity to the ionic surfactant present in said latex emulsion;

(ii) heating; and (iii) isolating said toner; and a process wherein (i) there is mixed a colorant dispersion and a latex generated from the emulsion polymerization of a mixture of from about 55 to about 85 weight percent of styrene, from about 1 to about 25 weight percent of butadiene, from about 1 to about 20 weight percent of acrylonitrile, and from about 0.5 to about 5 weight percent acrylic acid; and thereafter (ii) heating the resultant mixture at a temperature of about 30° C. to about 1° C. below the Tg of the latex resin to form aggregates; and (iii) subsequently heating said aggregates at a temperature of from about 10° C. to about 60° C. above Tg of the latex resin, and whereby coalescence is accomplished.

The present invention relates to toners and processes thereof. In embodiments of the present invention, there are provided economical processes for toner compositions with, for example, specific toner resins which enable improved image fix to paper as generally characterized by lower image crease, and excellent image gloss as characterized by high image gloss value, and wherein the toner particle size is in the range of from about 1 to about 20 microns, or more preferably from about 2 to 10 microns in volume average diameter, and which toners possess a narrow GSD of, for example, less than about 1.35, and preferably of less than about 1.25, enabling enhanced image resolution, lower image pile height, and thus eliminating or minimizing undesirable image text feel and paper curl. The toners of the present invention in embodiments possess excellent blocking temperatures, for example, no blocking of the toner at about 49° C.

More specifically, the present invention is directed to a chemical toner process which avoids conventional known toner pulverization or classification methods, and wherein in embodiments toner compositions with a toner particle size as indicated herein and defined by volume average diameter is from about 1 to about 20, and preferably from about 2 to about 10 microns, and a narrow particle distribution as conventionally characterized by GSD of, for example, less than 1.35, and more specifically from about 1.15 to about 1.25 as measured on the Coulter Counter can be obtained. The toners resulting can be selected for known electrophotographic imaging and printing processes, inclusive of digital processes, enabling improvements in, for example, image quality as manifested by excellent image resolution and superior color fidelity, and excellent image gloss and fix characteristics.

The present invention is directed to a chemical process comprised of blending an aqueous colorant, especially pigment dispersion containing an ionic surfactant and optional additives, such as a charge control agent and a latex emulsion derived from emulsion polymerization of styrene, butadiene, acrylonitrile, and acrylic acid in the presence of an oppositely charged surfactant, and an optional nonionic surfactant, and wherein the latex size is in the range of, for example, from about 0.005 micron to about 1, or from about 0.05 to about 0.99 micron in volume average diameter; heating the resulting mixture with stirring at a temperature of, for example, from about 30° C. below to about 1° C. below the glass transition temperature (Tg) of the latex resin to form toner sized aggregates comprised of resin, colorant, such as pigment, and optional additives; and subsequently heating the aggregate suspension in the presence of optional additional anionic surfactant to a temperature of, for example, from about 10° C. to about 60° C. above the Tg of the latex resin to effect coalescence or fusion of the constituents of the aggregates to provide integral toner particles of a particle size of, for example, from about 2 to about 10 microns in volume average diameter, and a GSD of from about 1.10 to about 1.25. The amount of each of the ionic surfactants utilized in the process in embodiments is, for example, from about 0.01 to about 5 weight percent, while the nonionic surfactant is selected in an amount of, for example, from about 0 to about 5 weight percent of the reaction mixture. The size of the aforementioned aggregates is primarily controlled by the temperature at which the aggregation is conducted, and generally, higher temperatures generate larger aggregates, and thus larger final toner particles.

In a specific embodiment, the present invention is directed to processes for the preparation of toner compositions, which comprises blending, for example, with a high shearing device, such as a Brinkmann polytron, a sonicator or microfluidizer, an aqueous colorant, such as pigment dispersion containing water, and wherein the colorant is, for example, red, green, blue, orange, brown , and more specifically, carbon black pigment like REGAL 330®, phthalocyanine, quinacridone or RHODAMINE B™ type, and a cationic surfactant, such as benzalkonium chloride, and optional known charge control additives with a latex emulsion obtained, for example, from the emulsion polymerization of a mixture of acrylonitrile, butadiene, styrene, and acrylic acid, and which latex emulsion contains an anionic surfactant, such as sodium dodecylbenzene sulfonate, and a nonionic surfactant; heating the resulting mixture at a temperature of from about 30° C. to about 1° C. below about the Tg of the latex resin to induce formation of toner sized aggregates, and which aggregates are comprised of latex, colorant, such as pigment, and optional additive particles; effecting coalescence of the aggregates at a temperature of, for example, from about 10° C. to about 60° C. above about the Tg of the latex resin in the presence of additional anionic surfactant, wherein the components of the aggregates coalesce or fuse together to form integral toner particles; followed by cooling and isolating the resulting toner product, thereafter washing with water, and drying with, for example, a convection oven, an Aeromatic fluidized bed dryer, freeze dryer, or spray dryer to provide toners comprised of the aforementioned resin, colorant, and optional charge control additives, and which toners have a particle size of, for example, from about 1 to about 20 microns, and more specifically, from about 2 to about 10 microns in volume average particle diameter as measured by a Coulter Counter and a GSD of from about 1.10 to about 1.25 as measured by a Coulter Counter.

A process for the preparation of toner compositions comprised of pigment, optional additives, and certain specific emulsion polymer resins derived from the emulsion polymerization of a mixture of acrylonitrile, butadiene, styrene, and acrylic acid monomers, comprises (i) providing, or preparing a latex emulsion by emulsion polymerization of acrylonitrile, butadiene, styrene, and acrylic acid in the presence of an anionic surfactant and a nonionic surfactant, and wherein acrylonitrile is selected in an amount of from about 1 to about 20 weight percent, butadiene is selected in an amount of from about 1 to about 25 weight percent, styrene is selected in an amount of from about 55 to 85 weight percent, and acrylic acid is selected in an amount of from about 0.5 to about 5 weight percent;

(ii) blending the resulting latex emulsion with an aqueous colorant, especially pigment dispersion containing a cationic surfactant with a high shearing device;

(iii) heating the resultant mixture with gentle stirring at a temperature of from about 30° C. to about 1° C. below the resin Tg to form toner sized aggregates comprised of latex, pigment, and optional additive particles, such as wax, charge control agents, and the like, and wherein the aggregate size is in the range of from about 2 to about 10 microns in volume average diameter, and the aggregate GSD is from about 1.10 to about 1.25; and (iv) heating the aggregate suspension at about 65° C. to about 110° C. in the presence of additional anionic surfactant to convert the aggregates into integral toner particles comprised of a pigment, optional additives, and a polymer resin of acrylonitrile, butadiene, styrene, and acrylic acid; and optionally, but preferably (v) cooling and isolating the toner product, followed by washing, drying, and optionally blending with surface additives.

Also, the present invention is directed to processes for the preparation of toner compositions which comprises (i) preparing a pigment mixture by dispersing optional charge control additives and a pigment, such as carbon black like REGAL 330®, HOSTAPERM PINK™, or PV FAST BLUE™ in an amount of from about 1 to about 20 percent by weight of toner in an aqueous mixture containing a cationic surfactant such as dialkylbenzene dialkylammonium chloride, for example SANIZOL B-50™ available from Kao or MIRAPOL™ available from Alkaril Chemicals, utilizing a high shearing device, such as a Brinkman Polytron or IKA homogenizer; (ii) adding the resulting pigment dispersion to a latex emulsion derived from emulsion polymerization of a mixture of acrylonitrile, butadiene, styrene, and acrylic acid in the presence of an anionic surfactant such as sodium dodecylsulfate, dodecylbenzene sulfonate or NEOGEN R™ and a nonionic surfactant, such as polyethylene glycol or polyoxyethylene glycol nonyl phenyl ether or IGEPAL 897™ obtained from GAF Chemical Company; (iii) homogenizing the above mixture using a high shearing device, such as a Brinkman Polytron or IKA homogenizer, at a speed of from about 3,000 revolutions per minute to about 10,000 revolutions per minute for a duration of from about 1 minute to about 120 minutes, and heating the resultant mixture at a temperature of from 30° C. below to 1° C. below the Tg of the latex resin while mechanically stirring at a speed of from about 250 to about 500 rpm to effect formation of electrostatically bound aggregates of from about 2 microns to about 20 microns in volume average diameter; (iv) subsequently heating the aggregate mixture at 65° C. to about 110° C. for a duration of about 30 minutes to a few hours, such as about 2 to about 5 hours in the presence of additional anionic surfactant in an amount of from about 0.01 percent to about 5 percent by weight to form integral toner particles of from about 2 to about 20 microns in volume average diameter and a GSD of from about 1.10 to about 1.25 as measured by the Coulter Counter; cooling and (v) isolating the toner particles by washing, filtering and drying, thereby providing toner particles comprised of a styrene-butadiene-acrylonitrile-acrylic acid resin, pigment, and optional charge control additives. Flow additives to improve flow properties may be optionally added to the toner obtained by blending with the toner, which additives include AEROSILS® or silicas, metal oxides like tin, titanium and the like, metal salts of fatty acids like zinc stearate, and which additives can each be present in various effective amounts, such as from about 0.1 to about 5 percent by weight of toner.

The toner composition, or toner particles can be comprised of colorant, and an addition polymer resin derived, for example, from about 55 to about 85 weight percent of styrene, from about 1 to about 25 weight percent of butadiene, from about I to about 20 weight percent of acrylonitrile, and from about 0.5 to about 5 weight percent of acrylic acid; a toner comprised of colorant, and a styrene-butadiene-acrylonitrile-acrylic acid resin obtained from emulsion polymerization of from about 55 to about 85 weight percent of styrene, from about 5 to about 25 weight percent of butadiene, from about 1 to about 20 weight percent of acrylonitrile, and from about 0.5 to about 5 weight percent of acrylic acid, and wherein the resin possesses a weight average molecular weight ($M_w$) of from about 15,000 to about 35,000 and a number average molecular weight ($M_n$) of from about 3,000 to about 10,000, relative to styrene standards; a toner composition comprised of colorant, and a styrene-butadiene-acrylonitrile-acrylic acid resin generated from the emulsion polymerization of from about 65 to about 82 weight percent of styrene, from about 15 to about 25 weight percent of butadiene, from about 1 to about 10 weight percent of acrylonitrile, and from about 0.5 to about 3 weight percent of acrylic acid; and wherein the resin has a weight average molecular weight ($M_w$) of from about 18,000 to about 30,000 and a number average molecular weight ($M_n$) of from about 5,000 to about 10,000, relative to styrene standards; a toner composition wherein the resin possesses an $M_w$ of from about 20,000 to about 30,000, and an $M_n$ of from about 5,000 to about 8,000, relative to styrene standards; a process for the preparation of toner comprising (i) preparing in the presence of an ionic surfactant and an optional nonionic surfactant a latex emulsion generated from the emulsion polymerization of a mixture of from about 55 to about 85 weight percent of styrene, from about 1 to about 25 weight percent of butadiene, from about 1 to about 20 weight percent of acrylonitrile, and from about 0.5 to about 5 weight percent of acrylic acid;

(ii) mixing the latex emulsion by high shear blending with an aqueous colorant dispersion containing an ionic surfactant that is of opposite charge polarity to the ionic surfactant in said latex emulsion;

(iii) heating the resultant mixture at a temperature of about 30° C. to about 1° C. below the Tg of the latex resin to form toner sized aggregates;

(iv) subsequently heating said aggregate suspension at a temperature of from about 10° C. to about 60° C. above the Tg of the latex resin to form integral toner product; and (v) followed by washing, drying, and dry blending the toner with surface additives.

In another embodiment thereof, the present invention is directed to an economical chemical process comprised of first mixing an aqueous pigment dispersion containing a pigment, such as HELIOGEN BLUE™ or HOSTAPERM PINK™, and a cationic surfactant, such as benzalkonium chloride (SANIZOL B-50™), with a latex emulsion comprised of suspended resin particles derived from the emulsion polymerization of styrene, butadiene, acrylonitrile, and acrylic acid monomers in the presence of an anionic surfactant, such as sodium dodecylbenzene sulfonate, for example NEOGEN R™ or NEOGEN SC™, and a nonionic surfactant, such as alkyl phenoxy poly(ethylenoxy)ethanol, for example IGEPAL 897™ or ANTAROX 897™, and which latex has a particle size of from, for example about 0.005 to about 1.0 micron in volume average diameter as measured by the Brookhaven Nanosizer; heating the resultant flocculent mixture of latex, pigment, optional known toner additive particles and surfactants at a temperature from about 30° C. to about 1° C. below the Tg of the latex resin to form aggregates of an aggregate size of from about 2 microns to about 10 microns in volume average diameter as measured by the Coulter Counter; subsequently heating the aggregate suspension at about 10° C. to about 60° C. above the Tg of the latex resin in the presence of additional anionic surfactant to convert the aggregates into integral toner particles, followed by cooling, and isolating the toner product.

Toners prepared in accordance with the present invention enable in embodiments the use of lower toner fusing temperatures, such as from about 120° C. to about 170° C., thereby preserving image resolution, and minimizing or preventing image spread, and eliminating or minimizing paper curl while prolonging the life of fuser rolls at lower temperatures. The toners are particularly useful for the generation of high quality colored images with excellent image fix and gloss, excellent image resolution and color fidelity on a wide array of paper substrates. For the relatively low molecular weight resins which are utilized in the toner compositions of the present invention in embodiments, the inclusion of acrylonitrile and butadiene moieties in the resin composition in effective amounts is of importance to achieving excellent image fix and gloss characteristics, and improving the toner resistance to frictional and mechanical breakage in the development housing.

Of importance with respect to the toner compositions of the present invention is the selection of a styrene-butadiene-acrylonitrile-acrylic acid resin, which is obtained, for example, from the emulsion polymerization of styrene, butadiene, acrylonitrile, and acrylic acid in respective effective amounts of, for example, from about 55 to about 85 weight percent, about 1 to about 25 weight percent, about 1 to about 20 weight percent, and about 0.5 about to 5 weight percent. Effective amounts of the selected resin in the oner compositions of the present invention range from, for example, about 80 weight percent to about 98 weight percent of the toner.

Various known colorants or pigments, such as pigments, mixtures of pigments, dye, mixtures of dyes, mixtures of dyes and pigments, and the like, present in the toners in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue, or mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5dimethoxy acetoacetanilide, and Permanent Yellow FGL.

Colorant includes pigment, dye, mixtures thereof, mixtures of pigments, mixtures of dyes, and the like.

Surfactants in amounts of, for example, about 0.01 to about 15 weight percent in embodiments include, for example, nonionic surfactants, such as dialkylphenoxypoly (ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0 to about 5 percent by weight of total reaction mixture.

Examples of ionic surfactants include anionic and cationic with examples of anionic surfactants being, for example, sodium dodecylsulfate, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 5 percent by weight, and preferably from about 0.01 to about 3 percent by weight of monomers used to prepare the copolymer resin particles of the emulsion or latex blend.

Examples of the cationic surfactants selected for the processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 percent to about 5 percent by weight of total reaction mixture. Preferably, the molar ratio of the cationic surfactant used for flocculation to the anionic surfactant used in the latex preparation is in the range of from about 0.5 to 4, and preferably from about 0.5 to 2.

Examples of the additional anionic surfactants, which can be added prior to coalescence primarily to prevent further growth in aggregate size with increasing temperature, include sodium dodecylbenzene sulfonate, sodium dodecylnaphthalene sulfate, dialkyl benzenealkyl sulfates and sulfonates, available from Aldrich, NEOGEN R™, NEOGEN SC™ obtained from Kao and the like. An effective concentration of this surfactant that stabilizes the aggregate size during coalescence ranges is, for example, from about 0.01 to about 5 percent by weight, and preferably from about 0.01 to about 3 percent by weight of the total reaction mixture.

Surface additives that can be added to the toner compositions after washing and drying include, for example, metal salts, metal salts of fatty acids, colloidal silicas, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and silicas, such as those available from Cabot Corporation and Degussa Chemicals, including, for example, AEROSIL R972® available from Degussa, and in amounts of from about 0.1 to about 2 percent. The additives can also be added during the aggregation or coalescence, or dry blending wherein additives are mechanically coated onto the surface of the toner product. The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference; nitrobenzene sulfonates; TRH a known charge enhancing additive aluminum complex, BONTRON E-84™ and BONTRON E-88™, and other known charge enhancing additives, and the like. Mixtures of charge additives may also be selected.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods, especially xerographic imaging and printing processes are also envisioned with the toners of the present invention, reference for example a number of the patents mentioned herein, and U.S. Pat. Nos. 4,585,884; 4,584,253; 4,563,408, and 4,265,990, the disclosures of which are totally incorporated herein by reference.

The following Examples are provided. These Examples are intended to be illustrative and are not intended to limit the scope of the present invention.

EXAMPLE I

An organic phase was prepared by blending 492.0 grams of styrene, 30.0 grams of acrylonitrile, 72.0 grams of butadiene, 12.0 grams of acrylic acid, and 21.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.9 grams of nonionic surfactant ANTAROX CA 897™. The organic phase was then added to the aqueous phase, and stirred at room temperature, about 25° C., for 30 minutes. Subsequently, the resulting mixture was heated to 70° C. at a rate of 1° C. per minute, and retained at this temperature for 6 hours. The resulting latex polymer had an $M_w$ of 32,000, an $M_n$ of 9,600 as measured by gel permeation chromatography with polystyrene standards, and a mid-point Tg of 54.5° C. as obtained by thermogravimetric analysis.

260 Grams of the above latex emulsion and 230 grams of an aqueous pigment dispersion containing 7.5 grams of dispersed BHD 6000 Sunsperse Cyan Pigment (containing 54.4 weight percent of solids) obtained from Sun Chemicals, and 2.6 grams of cationic surfactant SANIZOL B™ were simultaneously added to 400 grams of water with high shear stirring by means of a polytron. This mixture was transferred to a 2 liter reaction vessel and heated at a temperature of 50° C. for 1.5 hour before 28 milliliters of 20 percent aqueous NEOGEN R™ solution were added. Subsequently, the mixture was heated to 95° C. and held there for a period of 5 hours, followed by cooling, and isolating the toner product by filtration. The resulting toner product, which was comprised of 96.2 weight percent of resin and 3.8 weight percent of cyan pigment, and wherein the resin was comprised of about 81 parts by weight of styrene, about 12 parts by weight of butadiene, about 5 parts by weight of acrylonitrile and about 2 parts by weight of acrylic acid, showed a particle size of 6.6 microns in volume average diameter, and a GSD of 1.20 as measured with a Coulter Counter.

Fusing properties of the toner compositions of the present invention were evaluated as follows. Unfused images of toner on paper with a controlled toner mass per unit area of 1.2 mg/cm$^2$ were produced in accordance with the following procedure.

A suitable electrophotographic developer was generated by mixing from about 2 to about 10 percent by weight of the toner with a suitable electrophotographic carrier, such as, for example, a 90 micron diameter ferrite core spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured with a Faraday Cage. The developer was then introduced into a small electrophotographic copier, such as a Mita DC-111 in which the fuser system had been disconnected. Between about 20 and about 50 unfused images of a test pattern consisting of a 65 millimeter by 65 millimeter square solid area were produced on 8½ by 11 inch sheets of a typical electrophotographic paper such as Xerox Corporation Image LX© paper.

The unfused images were then fused by feeding them through a hot roll fuser system with a fuser roll and pressure roll with Viton surfaces, both of which were heated to a controlled temperature. Fused images were produced over a range of hot roll fusing temperatures of from about 130° C. to about 210° C. The gloss value of the fused images was measured according to TAPPI Standard T480 at a 75° angle of incidence and reflection using a Novo-Gloss© Statistical Glossmeter, Model GL-NG1002S from Paul N. Gardner Company, Inc. The degree of permanence of the fused images was evaluated by the known Crease Test. The fused image was folded under a specific weight with the toner image to the inside of the fold. The image was then unfolded and any loose toner wiped from the resulting crease with a cotton swab. The average width of the paper substrate, which shows through the fused toner image in the vicinity of the crease, was measured with a custom built image analysis system The fusing performance of a given toner is traditionally judged from the fusing temperatures required to achieve acceptable image gloss and fix. For high quality color applications, an image gloss greater than 50 gloss units is preferred. The minimum fuser temperature required to produce a gloss of 50 is defined as $T(G_{50})$ for a given toner. Similarly, the minimum fuser temperature required to produce a crease value less than the maximum acceptable crease of traditionally 65 crease units is known as the Minimum Fix Temperature (MFT) for a given toner. In general, it is desirable to have both $T(G_{50})$ and MFT as low as possible, such as below 190° C., and preferably below 170° C., in order to minimize the power requirements of the hot roll fuser and prolong its serviceable life.

The toner as prepared in this Example had a $T(G_{50})$ of 145° C. and an MFT of 140° C.

EXAMPLE II

An organic phase was prepared by blending 468.0 grams of styrene, 60.0 grams of acrylonitrile, 72.0 grams of butadiene, 12.0 grams of acrylic acid, and 19.5 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.9 grams of nonionic surfactant ANTAROX CA 897™. The organic phase was then added to the aqueous phase, and stirred at room temperature, about 25° C., for 30 minutes. The resulting mixture was heated to 70° C. at a rate of 1° C. per minute, and held at this temperature for 6 hours. The resulting latex polymer displayed an $M_w$ of 28,900, an $M_n$ of 7,200, and a mid-point Tg of 53.9° C.

260 Grams of the above latex emulsion and 230 grams of an aqueous pigment dispersion containing 7.5 grams of dispersed BHD 6000 Sunsperse Cyan Pigment (containing 54.4 weight percent of solids) obtained from Sun Chemicals, and 2.6 grams of cationic surfactant SANIZOL B™ were simultaneously added to 400 grams of water with high shear stirring by means of a polytron. The mixture was transferred to a 2 liter reaction vessel and heated at a temperature of 50° C. for 1.0 hour before 20 milliliters of 20 percent aqueous NEOGEN R™ solution were added. Subsequently, the mixture was heated to 95° C. and held there for a period of 4 hours. The resulting toner product, which was comprised of 96.2 weight percent of resin and 3.8 weight percent of cyan pigment, and wherein the resin was derived from about 76 parts by weight of styrene, about 12 parts by weight of butadiene, about 5 parts by weight of acrylonitrile, and about 2 parts by weight of acrylic acid, showed a particle size of 7.2 microns in volume average diameter and a GSD of 1.22 as measured with a Coulter Counter.

The toner was evaluated in accordance with the procedure of Example I, and a $T(G_{50})$ of 139° C. and an MFT of 136° C. were obtained.

EXAMPLE III

An organic phase was prepared by blending 488.0 grams of styrene, 40.0 grams of acrylonitrile, 72.0 grams of butadiene, 12.0 grams of acrylic acid, and 18.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.9 grams of nonionic surfactant ANTAROX CA 897™. The organic phase was then added to the aqueous phase, and stirred at room temperature for 30 minutes. The resulting mixture was heated to 70° C. at a rate of 1° C. per minute and held at this temperature for 6 hours. The resulting latex polymer displayed an $M_w$ of 31,300, an $M_n$ of 8,100, and a mid-point Tg of 55.8° C.

260 Grams of the above latex emulsion and 230 grams of an aqueous pigment dispersion containing 7.5 grams of dispersed BHD 6000 Sunsperse Cyan Pigment (containing 54.4 weight percent of solids) obtained from Sun Chemicals, and 2.6 grams of cationic surfactant SANIZOL B™ were simultaneously added to 400 grams of water with high shear stirring by means of a polytron. The mixture was transferred to a 2 liter reaction vessel and heated at a temperature of 53° C. for 2.0 hours before 35 milliliters of 20 percent aqueous NEOGEN R™ solution were added. Subsequently, the mixture was heated to 95° C. and held there for a period of 4 hours, followed by cooling to room temperature. The resulting toner product was comprised of 96.2 weight percent of resin and 3.8 weight percent of cyan pigment, and wherein the resin was derived from about 79 parts by weight of styrene, about 12 parts by weight of butadiene, about 7 parts by weight of acrylonitrile and about 2 parts by weight of acrylic acid evidenced a particle size of 7.3 microns and a GSD of 1.20 as measured with a Coulter Counter.

The toner was evaluated in accordance with the procedure of Example I, and a $T(G_{50})$ of 142° C. and an MFT of 138° C. were obtained.

EXAMPLE IV

An organic phase was prepared by blending 448.0 grams of styrene, 80.0 grams of acrylonitrile, 72 grams of butadiene, 12.0 grams of acrylic acid, and 18.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.9 grams of nonionic surfactant ANTAROX CA 897™. The organic phase was then added to the aqueous phase, and stirred at room temperature, about 25° C. throughout, for 30 minutes. The resulting mixture was heated to 70° C. at a rate of 1° C. per minute, and held at this temperature for 6 hours. The resulting latex polymer displayed an $M_w$ of 32,300, an $M_n$ of 8,800, and a mid-point Tg of 57.8° C.

260 Grams of the above latex emulsion and 230 grams of an aqueous pigment dispersion containing 7.5 grams of dispersed BHD 6000 Sunsperse Cyan Pigment (containing 54.4 weight percent of solids) obtained from Sun Chemicals, and 2.6 grams of cationic surfactant SANIZOL B™ were simultaneously added to 400 grams of water with high shear stirring by means of a polytron. The mixture was transferred to a 2 liter reaction vessel and heated at a temperature of 52° C. for 3.0 hours before 35 milliliters of 20 percent aqueous NEOGEN R™ solution were added. Subsequently, the mixture was heated to 95° C. and held there for a period of 4.5 hours, followed by cooling and isolation or separation of the toner. The resulting toner product was comprised of 96.2 weight percent of resin and 3.8 weight percent of cyan pigment, and wherein the resin was derived from about 73 parts by weight of styrene, about 12 parts by weight of butadiene, about 13 parts by weight of acrylonitrile, and about 2 parts by weight of acrylic acid showed a particle size of 7.0 microns and a GSD of 1.21 as measured with a Coulter Counter.

The toner was evaluated in accordance with the procedure of Example I, and a $T(G_{50})$ of 145° C. and an MFT of 142° C. were obtained.

EXAMPLE V

An organic phase was prepared by blending 468.0 grams of styrene, 60.0 grams of acrylonitrile, 78 grams of butadiene, 12.0 grams of acrylic acid, and 19.5 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.8 grams of nonionic surfactant ANTAROX CA 897™. The organic phase was then added to the aqueous phase, and stirred at room temperature for 30 minutes. The resulting mixture was heated to 70° C. at a rate of 1° C. per minutes, and held at this temperature for 6 hours. The resulting latex polymer displayed an $M_w$ of 28,500, an $M_n$ of 6,500, and a mid-point Tg of 52.3° C.

260 Grams of the above latex emulsion and 230 grams of an aqueous pigment dispersion containing 7.5 grams of dispersed BHD 6000 Sunsperse Cyan Pigment (containing 54.4 weight percent of solids) obtained from Sun Chemicals, and 2.6 grams of cationic surfactant SANIZOL B™ were simultaneously added to 400 grams of water with high shear stirring by means of a polytron. The mixture was transferred to a 2 liter reaction vessel and heated at a temperature of 52° C. for 3.0 hours before 35 milliliters of 20 percent aqueous NEOGEN R™ solution were added. Subsequently, the mixture was heated to 95° C. and held there for a period of 3 hours, followed by cooling and isolation of the toner. The resulting toner product was comprised of 96.2 weight percent of resin and 3.8 weight percent of cyan pigment, and wherein the resin was derived from about 75 parts by weight of styrene, about 13 parts by weight of butadiene, about 10 parts by weight of acrylonitrile, and about 2 parts by weight of acrylic acid showed a particle size of 6.9 microns in volume average diameter and a GSD of 1.23 as measured with a Coulter Counter.

The toner was evaluated in accordance with the procedure of Example I, and a $T(G_{50})$ of 134° C. and an MFT of 139° C. were obtained.

No signs of blocking of the above prepared invention toners was observed at 49° C. over a 24 hour period.

COMPARATIVE EXAMPLE A

An organic phase was prepared by blending 516 grams of styrene, 84 grams of styrene, 12.0 grams of acrylic acid, and 21.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.9 grams of nonionic surfactant ANTAROX CA 897™. The organic phase was then added to the aqueous phase, and stirred at room temperature, about 25° C., for 30 minutes. Subsequently, the resulting mixture was heated to 70° C. at a rate of 1° C. per minute, and held at this temperature for 6 hours. The resulting latex polymer had an $M_w$ of 29,900, an $M_n$ of 10,600, and a mid-point Tg of 53.4° C.

A cyan toner was subsequently prepared from this latex in accordance with the procedure of Example I. The toner, which was comprised of 96.2 weight percent of resin and 3.8 weight percent of cyan pigment, and wherein the resin was derived from about 84 parts by weight of styrene, about 14 parts by weight of butadiene, and about 2 parts by weight of acrylic acid, showed a particle size of 7.1 microns and a GSD of 1.22.

Fusing evaluation showed that the toner had a Gloss 50 temperature T ($G_{50}$) of 140° C. and an MFT of 165° C. This Comparative Example showed that the toner whose resin contained no acrylonitrile component fused at a higher temperature.

COMPARATIVE EXAMPLE B

An organic phase was prepared by blending 540.0 grams of styrene, 60.0 grams of butadiene, 12.0 grams of acrylic acid, and 21.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant NEOGEN R™ and 12.9 grams of nonionic surfactant ANTAROX CA 897™. The organic phase was then added to the aqueous phase, and stirred at room temperature, about 25° C., for 30 minutes. Subsequently, the resulting mixture was heated to 70° C. at a rate of 1° C. per minute, and held at this temperature for 6 hours. The resulting latex polymer had an $M_w$ of 29,500, an $M_n$ of 11,000, and a mid-point Tg of 57.0° C.

A cyan toner was subsequently prepared from this latex in accordance with the procedure of Example I. The toner product, which was comprised of 96.2 weight percent of resin and 3.8 weight percent of cyan pigment, and wherein the resin was derived from about 88 parts by weight of styrene, about 10 parts by weight of butadiene, and about 2 parts by weight of acrylic acid, showed a particle size of 6.3 microns and a GSD of 1.20.

Fusing evaluation showed that the toner had a Gloss 50 temperature T ($G_{50}$) of 169° C. and an MFT of 158° C.

Other modifications of the present invention may occur to those of ordinary skill in the art subsequent to a review of the present application and these modifications, including equivalents thereof, are intended to be included within the scope of the present invention.

What is claimed is:

1. A toner composition comprised of colorant, and an addition polymer resin of styrene, butadiene, acrylonitrile and acrylic acid wherein said resin possesses a weight average molecular weight (Mw) of from about 15,000 to about 35,000 and a number average molecular weight (Mn) of from about 3,000 to about 12,000, relative to styrene standards.

2. A toner composition in accordance with claim 1 wherein said resin is derived from about 55 to about 85 weight percent of styrene, from about 1 to about 25 weight percent of butadiene, from about 1 to about 20 weight percent of acrylonitrile, and from about 0.5 to about 5 weight percent of acrylic acid.

3. A toner composition in accordance with claim 1 containing a styrene-butadiene-acrylonitrile-acrylic acid resin derived from emulsion polymerization of from about 65 to about 80 weight percent of styrene, from about 15 to about 25 weight percent of butadiene, from about 1 to about 10 weight percent of acrylonitrile, and from about 0.5 to about 3 weight percent of acrylic acid; and wherein said resin has a weight average molecular weight ($M_w$) of from about 18,000 to about 30,000 and a number average molecular weight ($M_n$) of from about 5,000 to about 10,000, relative to styrene standards.

4. A toner in accordance with claim 1 wherein the resin possesses an $M_w$ of from about 20,000 to about 30,000, and an $M_n$ of from about 5,000 to about 10,000, relative to styrene standards.

5. A toner in accordance with claim 2 wherein the resin possesses an $M_w$ of from about 20,000 to about 25,000, and an $M_n$ of about 6,000 to 8,000, relative to the styrene standards.

6. A toner in accordance with claim 2 wherein the toner provides excellent image fix at a fusing temperature of from about 125° C. to about 170° C., and wherein the toner image gloss is 50, and $G_{50}$ temperature thereof is from about 130° C. to about 165° C.

7. A toner in accordance with claim 2 wherein the colorant is selected from the group consisting of black, cyan, magenta, yellow, blue, a green, brown, and mixtures thereof.

8. A toner in accordance with claim 2 further containing a charge control additive.

9. A toner in accordance with claim 8 wherein the charge control additive is selected from the group consisting of distearyl dimethyl ammonium methyl sulfate, cetyl pyridinium halide, distearyl dimethyl ammonium bisulfate, metal complexes of salicylates, and mixtures thereof.

10. A toner in accordance with claim 2 further containing wax, and surface additives.

11. A developer comprised of the toner of claim 1 and carrier.

12. A developer in accordance with claim 11 wherein said toner is comprised of colorant, and a styrene-butadiene-acrylonitrile-acrylic acid resin is obtained from emulsion polymerization of from about 55 to about 82 weight percent of styrene, from about 5 to about 25 weight percent of butadiene, from about 1 to about 20 weight percent of acrylonitrile, and from about 0.5 to about 5 weight percent of acrylic acid; and wherein said resin has a weight average molecular weight ($M_w$) of from about 15,000 to about 35,000 and a number average molecular weight ($M_n$) of from about 3,000 to about 12,000, relative to styrene standards.

13. A developer in accordance with claim 11 wherein the carrier is comprised of a metal core with a polymer coating.

14. A process for the preparation of toner comprising (i) preparing in the presence of an ionic surfactant and an optional nonionic surfactant a latex emulsion generated from the emulsion polymerization of a mixture of from about 55 to about 85 weight percent of styrene, from about 1 to about 25 weight percent of butadiene, from about 1 to about 20 weight percent of acrylonitrile, and from about 0.5 to about 5 weight percent acrylic acid;

(ii) mixing said latex emulsion with an aqueous colorant dispersion containing an ionic surfactant that is of opposite charge polarity to the ionic surfactant present in said latex emulsion;

(iii) heating the resultant mixture at a temperature of about 30° C. to about 1° C. about below, or about equal to the Tg of the latex resin to form aggregates;

(iv) subsequently heating said aggregates at a temperature of from about 10° C. to about 60° C. about above, or about equal to the Tg of the latex resin; and optionally (v) cooling, and isolating said toner, followed by washing, and drying.

15. A process in accordance with claim 14 wherein the aggregate size, and thus the final toner particle size is from about 1 to about 15 microns in volume average diameter, and wherein (v) is accomplished.

16. A process in accordance with claim 14 wherein the final toner particle size distribution GSD is less than about 1.35, and wherein (v) is accomplished.

17. A process in accordance with claim 14 wherein acrylonitrile in said emulsion polymerization is present in amounts of about 2 to 10 weight percent, and wherein (v) is accomplished.

18. A process in accordance with claim 14 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate and sodium dodecylnaphthalene sulfate, and wherein (v) is accomplished.

19. A process in accordance with claim 14 wherein the nonionic surfactant concentration is from about 0 to about 5 weight percent, the anionic surfactant concentration is about 0.01 to about 10 weight percent, and the cationic surfactant concentration is about 0.01 to about 10 weight percent of the reaction mixture; and wherein (v) is accomplished.

20. A process for the preparation of toner comprising (i) mixing a latex containing styrene, butadiene, acrylonitrile, acrylic acid and an ionic surfactant, and an aqueous colorant dispersion containing an ionic surfactant that is of opposite charge polarity to the ionic surfactant present in said latex emulsion;

(ii) heating; and (iii) isolating said toner.

21. A process in accordance with claim 20 wherein (i) there is mixed a latex generated from the emulsion polymerization of a mixture of from about 55 to about 85 weight percent of styrene, from about 1 to about 25 weight percent of butadiene, from about 1 to about 20 weight percent of acrylonitrile, and from about 0.5 to about 5 weight percent acrylic acid; and thereafter (ii) heating the resultant mixture at a temperature of about 30° C. to about 1° C. below the Tg of the latex resin to form aggregates; and (iii) subsequently heating said aggregates at a temperature of from about 10° C. to about 60° C. above Tg of the latex resin, and whereby coalescence is accomplished.

22. A toner in accordance with claim 1 wherein the colorant is a pigment, or a dye.

* * * * *